United States Patent [19]

Collins et al.

[11] Patent Number: 5,062,173

[45] Date of Patent: Nov. 5, 1991

[54] MULTIFUNCTION TOOL

[76] Inventors: Michael C. Collins, 3075 Batesville Rd., Woodstock, Ga. 30188; Walter W. Collins, P.O. Box 100, North, S.C. 29112

[21] Appl. No.: 550,798

[22] Filed: Jul. 5, 1990

Related U.S. Application Data

[63] Continuation-in-part of Ser. No. 430,781, Nov. 2, 1989, abandoned.

[51] Int. Cl.[5] ..... B26B 11/00

[52] U.S. Cl. ..... 7/118; 7/128; 30/255

[58] Field of Search ..... 81/415, 427.5; 30/255; 7/126–130, 167, 118

[56] References Cited

U.S. PATENT DOCUMENTS

| | | | |
|---|---|---|---|
| 649,334 | 5/1900 | Meldos | 7/125 |
| 1,370,906 | 3/1921 | Newton | 30/255 |
| 1,511,340 | 10/1924 | Jackson | 7/131 X |
| 1,524,694 | 2/1925 | Di Maio | 30/255 X |
| 2,575,652 | 11/1951 | Bovee | 7/128 X |
| 4,238,862 | 12/1980 | Leatherman | 7/128 |
| 4,563,833 | 1/1986 | Aucoln | 7/128 X |
| 4,744,272 | 5/1988 | Leatherman | 7/128 X |

FOREIGN PATENT DOCUMENTS

| | | | |
|---|---|---|---|
| 30788 | 3/1885 | Fed. Rep. of Germany | 30/255 |

*Primary Examiner*—James G. Smith
*Attorney, Agent, or Firm*—Michael A. Mann

[57] ABSTRACT

A multifunction or combination tool having a screw driver, a wrench, a saw blade, a serrated blade, a metal file, and a knife blade divided into two groups, color-coded, and rotatably mounted in recesses in a two part handle, and a pair of pliers also rotatably mounted in the recesses of the handle, one pliers in each handle part so that the pliers can be rotated out of the recess and used in a range of positions at an angle from the handles as well as fully extended with or without rotating any of the remaining instruments. A latch attached to the pliers holds the two handle parts together when the pliers is not in use. The screw driver is adapted for turning both a phillips head and a flat head screw. Spring washers are used to separate the various implements and allow the compression of them to fit a set of implements into the handles of the multifunction tool.

13 Claims, 4 Drawing Sheets

150
160
110
90
20
120
130
140
26
24
30
28
22
60

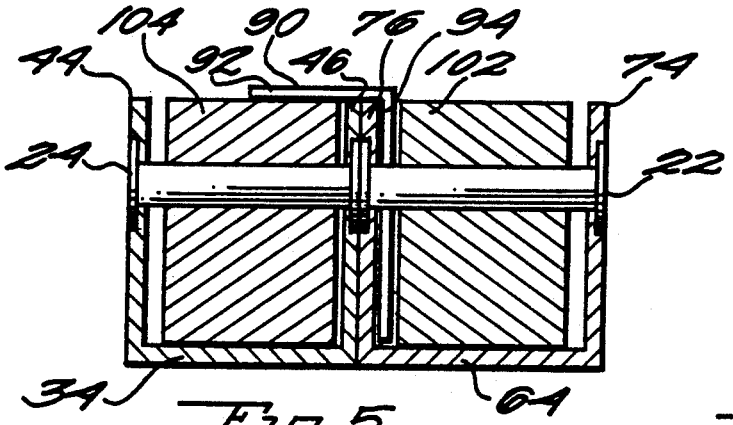
Fig. 5.
Fig. 6.
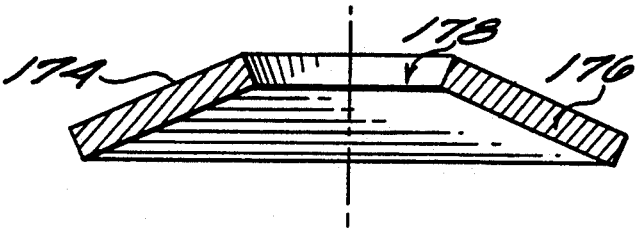
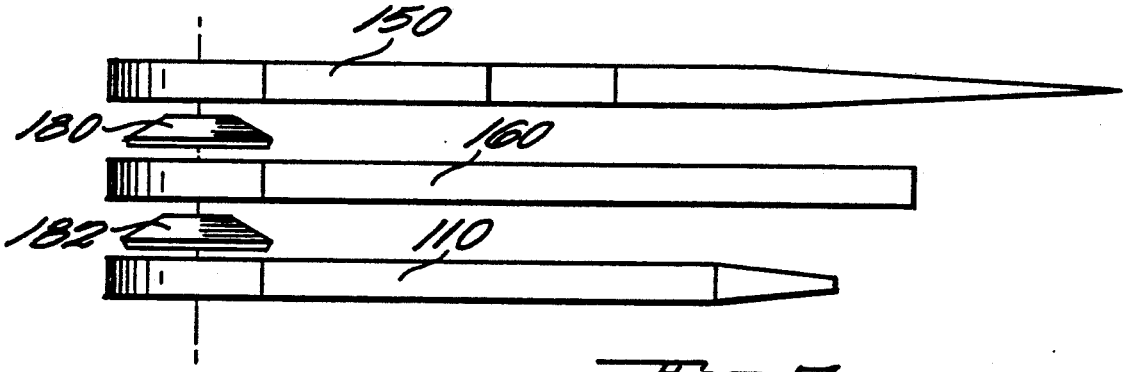
Fig. 7.
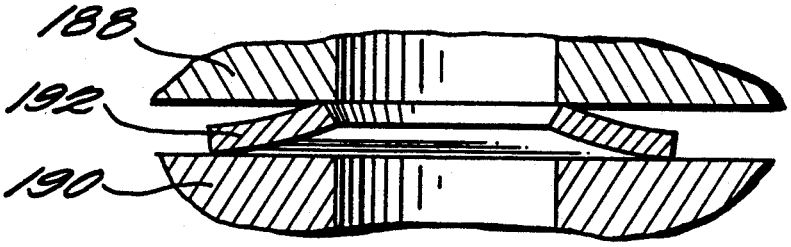
Fig. 8.

MULTIFUNCTION TOOL

This is a continuation-in-part of copending application Ser. No. 07/430,781 filed on Nov. 2, 1989, now abandoned.

FIELD OF THE INVENTION

The present invention relates to multifunction, or combination, tools.

DISCUSSION OF THE BACKGROUND

Multifunction or combination tools are well known. The most famous multifunction tool is the Swiss Army Knife which has a variety of instruments, each for a different purpose, rotatably attached within a case or housing that serves as a handle. See in particular German patent No. 30788 issued Mar. 12, 1885 to Klever. The design of such tools always involves compromises in the selection of instruments, their size and range of motion, and how they are to be deployed. Many combination tools are thus limited to having instruments for a particular purpose, such as grooming. Some combination tools having a great many instruments are simply poor substitutes for full size tools from a tool box.

Furthermore, many multifunction tools have screwdrivers but few have pliers to grip a small object such as a nut. Some tools have an ample assortment of instruments, including pliers, but the method for deployment may be involved or expose the hand to sharp edges. See for example U.S. Pat. Nos. 4,238,862 and 4,744,272 issued Dec. 1980 and May 1988 to Leatherman. There is a need for a combination tool having a reasonable number of easily deployable, high quality tools selected for mechanical use.

SUMMARY OF THE INVENTION

According to its major aspects, the present multifunction tool comprises a pair of pliers interconnected by a pivot pin. The pivot pin defines a first axis about which each pliers rotates cooperatively to grip an object. The pliers are attached to handles by a second and third pivot pin, respectively, to fold the pliers against the handles, rotating about axes perpendicular to the first axis. The handles have recesses dimensioned to receive the pliers. When the handles are brought together and the pliers are rotated about the second and third axes to their fully retracted position from their fully extended position, the pliers fit neatly into their own handles.

A group of tools is also housed in each handle recess, separated by spring washers deployable by rotating each individual instrument outwardly. These latter instruments include a serrated blade, a knife blade, a saw, a metal file, a three-size crescent wrench, and a screw driver capable or turning both phillips head and flat head screws. The instruments are preferably made of color coded stainless steel and the handles are preferably made of a glass-reinforced material such as nylon.

A feature of the present invention is the pliers which can be easily deployed from the recesses in the handles to any position in a range of positions from fully extended to nearly fully retracted. This feature has the advantage of allowing use of the pliers for gripping objects at an angle with respect to the handle.

Another feature of the present invention is the screw driver capable of turning a phillips head or flat head screw driver, having the advantage of requiring only one screw driver instrument rather than two.

Still another feature of the present invention is the selection of instruments: pliers, screw driver, wrench, saw, metal file, knife blade, and serrated blade. This combination of instruments provides a compact but complete set of instruments appropriate for activities of a mechanical nature, as opposed to grooming or as opposed to a large, general-purpose combination tool. The combination is ideal for mechanical activities taking place out of doors such as those related to fishing, hunting, camping, boating, or farming where a handy pocket tool having a range of instruments for mechanical purposes in a compact case is desirable.

Still another feature of the present invention is a latch for securing together the two handles of the multifunction tool when the pair of pliers is not in use.

Yet another feature of the present invention is the use of spring washers. The spring washers provide both-separation of the individual instruments and a bias against the instruments so that they do not rotate out of the recesses in the handles inadvertantly.

Other features and advantages of the present invention will be apparent to someone skilled in the art of combination or multifunction tools.

The present invention can be better appreciated by reference to the following detailed description of a preferred embodiment of the present invention, which is also illustrated in the accompanying drawings that are described below.

BRIEF DESCRIPTION OF THE FIGURES

FIG. 3 is a perspective view of the present invention showing the various instruments deployed according to the present invention.

FIG. 5 is a detailed view of the latch along line 5—5 of FIG. 2.

FIG. 6 is a side cross-sectional view of a spring washer.

FIG. 8 is a detailed cross sectional view of tools with a spring washer therebetween.

DETAILED DESCRIPTION OF A PRESENTLY PREFERRED EMBODIMENT

Figure 1:
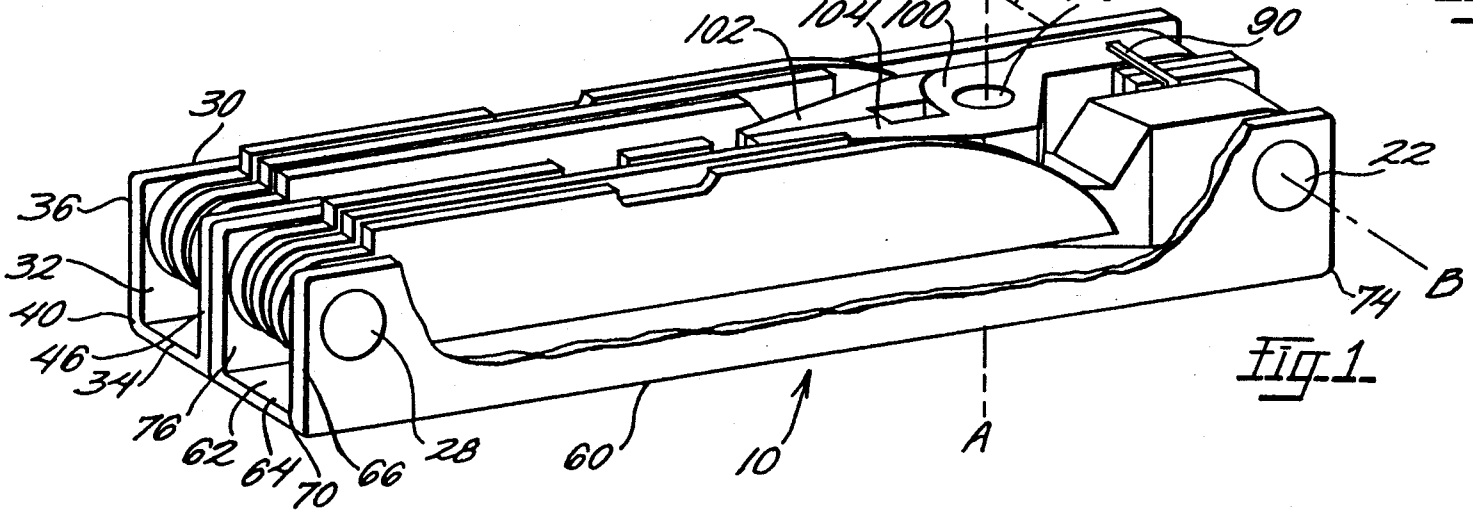
FIG. 1 is a perspective view of a preferred embodiment according to the present invention.

A presently preferred embodiment of the multifunction tool of the present invention is indicated by reference numeral 10 in FIG. 1. A left handle 30 and a right handle 60 house a rotatable pair of pliers 100 and also house all of the instruments of the multifunction tool. Rotatable pair of pliers 100 comprises a left pliers 102 and a right pliers 104 pivotally interconnected by a first pivot pin 20 so that left pliers 102 and right pliers 104 can cooperatively grip an object. First pivot pin 20 defines a first major axis A, about which left pliers 102 and right pliers 104 rotate.

Figure 2:
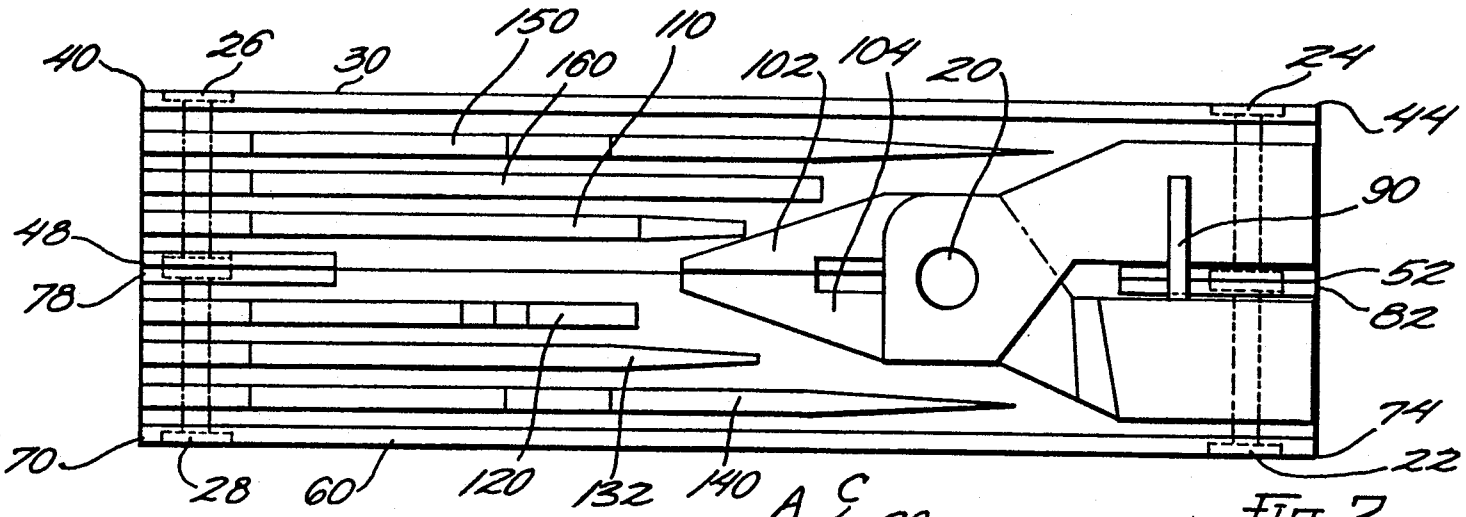
FIG. 2 is a top plan view of a preferred embodiment according to the present invention.

Other instruments of tool 10 include a screw driver 110, a 3-sized crescent wrench 120, a metal file 130, a knife blade 140, a serrated blade 150, and a saw 160, as shown in FIG. 2. These instruments are rotatably attached to left handle 30 and to right handle 60 by means of a fourth pivot pin 26 and a fifth pivot pin 28.

Left pliers 102 is rotatably attached to right handle 60 by means of a second pivot pin 22 so that left pliers 102 and right handle 60 pivot about a second major axis B that is perpendicular to first major axis A, as shown in FIG. 1. Right pliers 104 is rotatably attached to left handle 30 by means of a third pivot pin 24 so that left pliers 104 and left handle 30 pivot about a third major axis C that is perpendicular to first major axis A and aligned with second major axis B, allowing left pliers 102 and right pliers 104 to rotate together about second and third axes B and C, respectively, from a fully extended position to a fully retracted position. Left pliers 102 is received into a left recess 32 of left handle 30 and right pliers 104 is received into a right recess 62 of right handle 60. Left pliers 102 and right pliers 104 can be opened and closed by separating and bringing together left handle 30 and right handle 60. In addition, left pliers 102 and right pliers 104 cooperate not only to grip an object but also to hold the object over a range of angles between the fully extended and fully closed positions. Latch 90 holds pliers 100 closed.

FIG. 1 shows left recess 32 dimensioned to receive left pliers 102. Left handle 30 comprises a generally rectangular left bottom portion 34, a rectangular left side portion 36 that is joined to bottom portion 34 at approximately a 90 degree angle to form corners 40 and 44. Left handle 30 further comprises a rectangular left inner wall 46 joined to bottom portion 34 at approximately a 90 degree angle to form corners 48 and 52. Left recess 32 is defined by corners 40, 44, 48, and 52, as shown in FIG. 2.

FIG. 1 shows right recess 62 is dimensioned to receive right pliers 104. Right handle 60 comprises a generally rectangular bottom portion 64, a rectangular right side portion 66 that is joined to right bottom portion 64 at approximately a 90 degree angle to form corners 70 and 74. Right handle 60 further comprises a rectangular right inner wall 76 joined to bottom portion 64 at approximately a 90 degree angle to form corners 78 and 82. Right recess 62 is defined by corners 70, 74, 78 and 82, as shown in FIG. 2.

Left handle 30 and right handle 60 house the balance of the instruments in multifunctional tool 10. A perdpective view of tool 10 is shown in FIG. 3. Three instruments are housed in left recess 32 of left handle 30. They are rotatably attached to left handle 30 by means of fourth pivot pin 26 so that they rotate outwardly about a fourth major axis D that is parallel to second major axis B and third major axis C. Three instruments are housed in right recess 62 of right handle 60. They are rotatably attached to right handle 60 by means of fifth pivot pin 28 so that they rotate outwardly about a fifth major axis E that is parallel to second and third major axes B and C, respectively, and aligned with fourth major axis D. Each instrument can be deployed individually as will be described more fully below.

Pliers 100 comprises left pliers 102 and right pliers 104, with latch 90.

Figure 4:
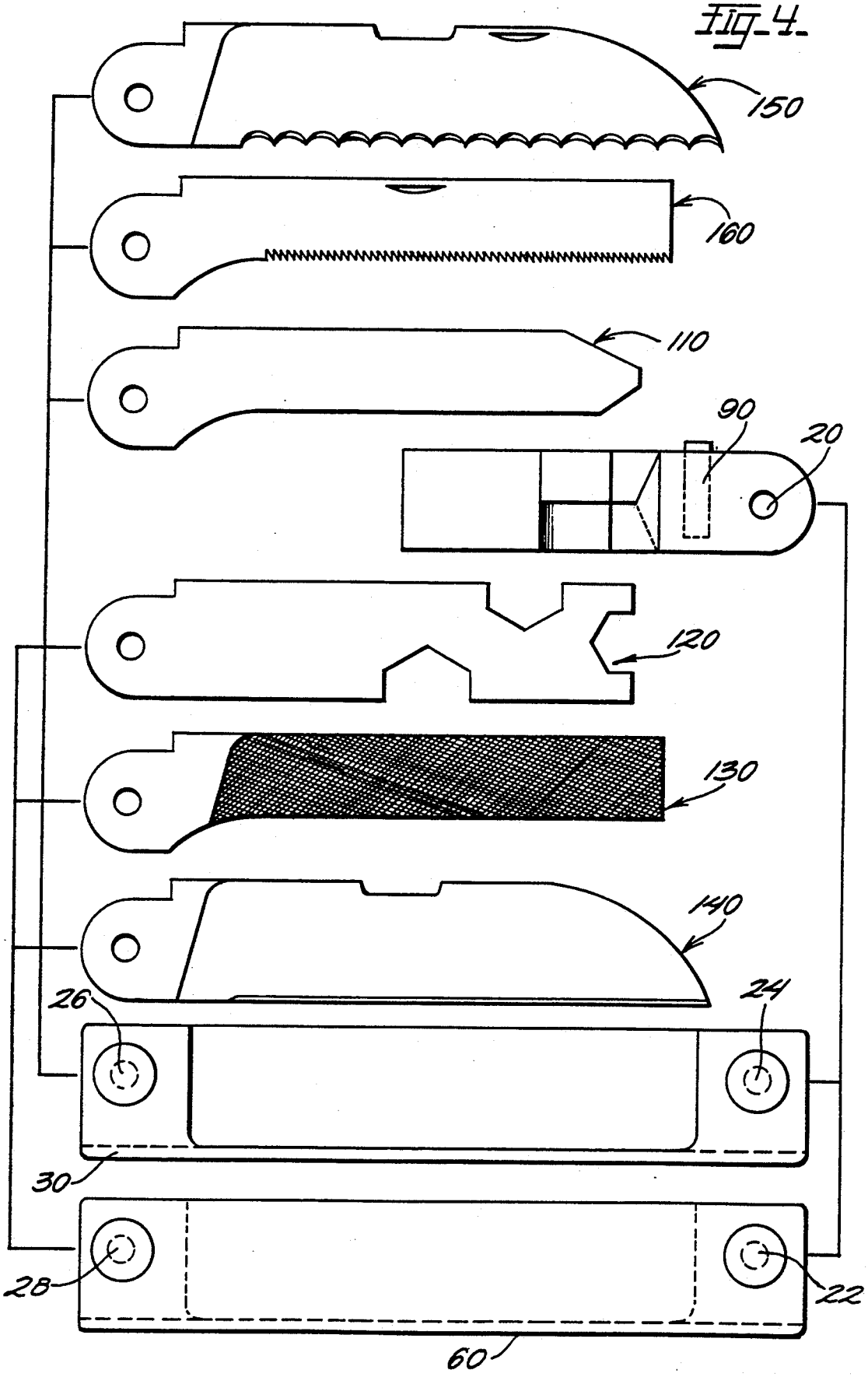
FIG. 4 is an exploded view of the present invention showing all the component parts as they relate spatially to each other in compact form.

FIGS. 1, 4 and 5 show latch 90 to have an "L" shape. FIG. 1 shows a horizontal component 92 attached to right pliers 104 and just clearing left and right inner walls 46, 76 and shows a vertical component of latch 94 of latch 90 between right inner wall 76 and left pliers 102. FIG. 4 shows fully vertical component 94 of latch 90. Vertical component 94 of latch 90 prevents the separating of left handle 30 from right handle 60 when right and left pliers 104 and 102 are received respectively in left recess 32 and right recess 62, but if left and right pliers members 102 and 104 are rotated about axis B, vertical component 94 of latch 90, raised with the rotating of right pliers 104 (as seen clearly from FIG. 5), clears left and right inner walls 46, 76 so that left handle 30 and right handle 60 may be separated and rotated about axis A.

Screw driver 110 comprises an elongated member having a first end 112 and a tapered second end 114. First end 112 is rotatably attached to left handle 30 by means of fourth pivot pin 26. Tapered second end 114 comprises a generally rectangular cross section in which a dimension 116 decreases gradually from a point 117 to a point 118, resulting in tapered second end 114 that will fit into the slot of a flat head screw or into any two aligned slots of a phillips head screw.

Three-size crescent wrench 120 comprises an elongated member having a first end 121 and a second end 122. First end 121 is rotatably attached to right handle 60 by means of fifth pivot pin 28. Second end 122 comprises wrenches 124, 126, and 128. Wrench 124 comprises four sides 125 of equal length, whereby any two adjacent sides define an approximately 120 degree angle. Wrench 126 comprises four sides 127 of equal length, whereby any two adjacent sides define a 120 degree angle; the length of sides 127 is not equal to the length of sides 125. Wrench 128 comprises four sides 129 of equal length, whereby any two adjacent sides define a 120 degree angle; the length of sides 129 is not equal to the length of sides 125 or 127.

Metal file 130 comprises an elongated member having a first end 132 and a second end 134. First end 132 is rotatably attached to right handle 60 by means of fifth pivot pin 28. Second end 134 comprises a generally rectangular cross section whose outer surface comprises raised parallel ridges 138 that are oriented at an approximately 45 degree angle to a dimension of the rectangular cross section.

Knife blade 140 comprises an elongated member having a first end 142 and a second end 144. First end 142 is rotatably attached to right handle 60 by means of fifth pivot pin 28. Second end 144 comprises a straight side 145 and a curved side 146 that meet at a point 147. Curved side 146 further comprises an open semi-elliptical notch 148.

Serrated blade 150 comprises an elongated member having a first end 152 and a second end 153. First end 152 is rotatably attached to left handle 30 by means of fourth pivot pin 26. Second end 153 comprises a straight, notched side 154 and a curved side 156 that meet at a point 159. Straight, notched side 154 further comprises a series of adjacent curved notches 155, and curved side 156 further comprises closed, semi-elliptical notch 157 and open, semi-elliptical notch 158.

Saw 160 comprises an elongated member having a first end 162 and a second end 164. First end 162 is rotatably attached to left handle 30 by means of fourth pivot pin 26. Second end 164 comprises a generally rectangular cross section having a straight, smooth side 166, a straight, jagged side 168, and a closed, semi-elliptical notch 167.

FIG. 4 shows an exploded view of the present invention, with all the component parts as they relate spatially to each other.

FIG. 6 shows a cross section of a spring washer 174 as used in the present invention for separating and retaining the various tools in left and right handles 30, 60.

Spring washer 174 is a conical washer however a sperical washer will also be suitable. Spring washer 174 has a conical body 176 and a hole 178.

Figure 7:
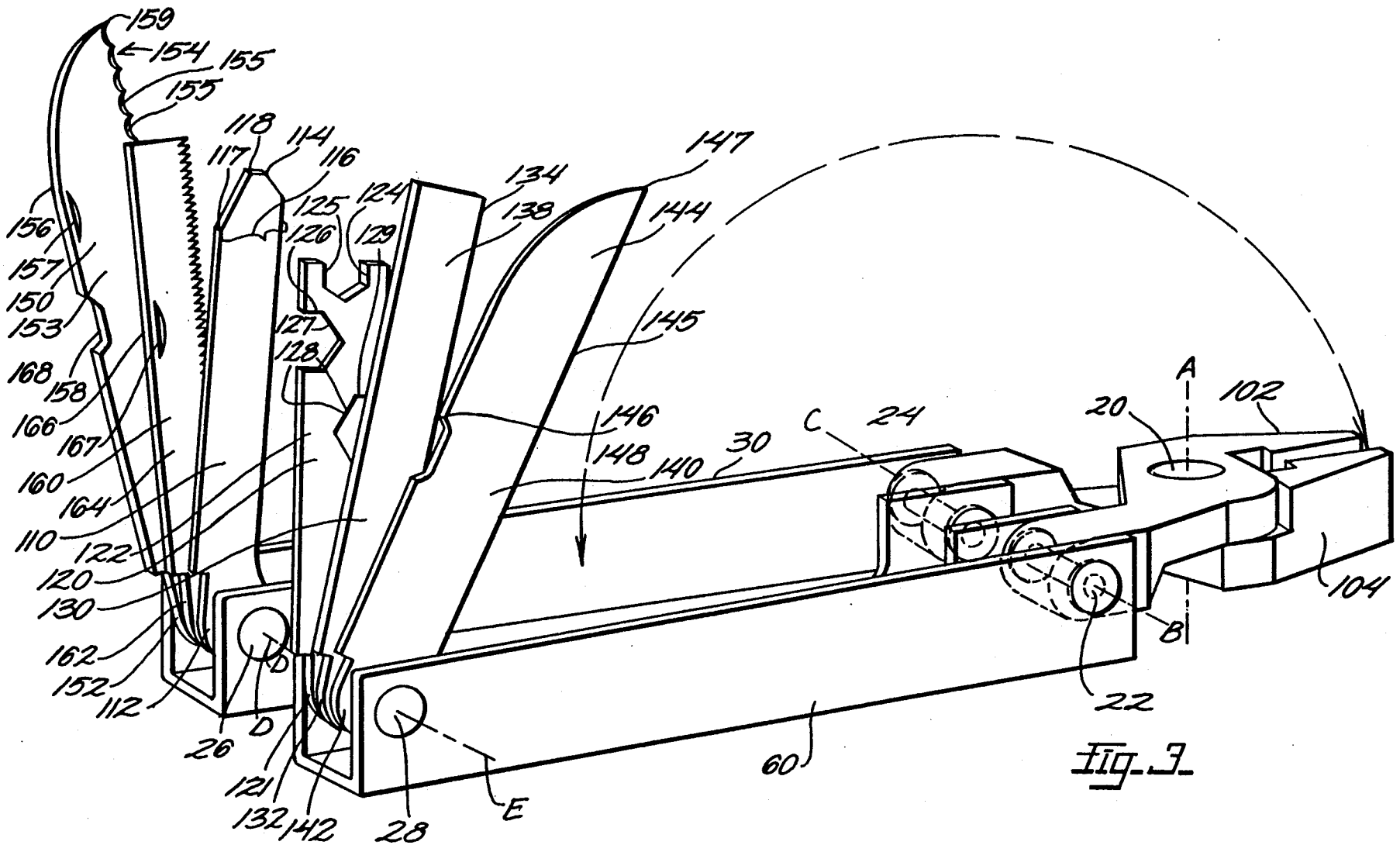
FIG. 7 is an exploded end view of the tools of the left handle of the present invention showing the position of the spring washers.

FIG. 7 shows and exploded, end view of the three implements of left handle 30 of multifunction tool 10; the configuration of washers in right handle 60 is the same and is therefore not shown. Two spring washers are used to separate the three instruments and provide a biasing force so that the individual instruments do not rotate out inadvertently. In left handle 30, between serrated blade 150 and saw 160 is a spring washer 180; a second spring washer 182 is between saw 160 and screw driver 110.

Spring washers 180 and 182 may be in the form of a conical spring washer 174, as seen in FIG. 6 or spherical. Spring washers 180 and 182 are inserted between the various implements as described and then pressure is exerted to compress the assembled components for placing into recesses 1 and 2. The pivot pins are then inserted to hold the assembled components in place. Spring washers 180 and 182 deform slightly under compression as shown in FIG. 8 where two implements 188 and 190 are separated by washer 192 which is deformed under compression.

All of the instruments of the multifunction tool are preferably made of stainless steel and color coded, such as by coating with colored "TEFLON" a trademark of the E. I. Dupont de Nemours & Co., Inc., or by electroplating. Left handle 30 and right handle 60 are preferably made of a moldable, glass-filled, or glass-reinforced material such as nylon or lexan.

What is claimed is:

1. A tool comprising:

a left pliers;

a right pliers;

a first pivot means for pivotally interconnecting said left and said right pliers so that said left pliers and said right pliers can cooperatively hold an object therebetween, said left and said right pliers pivoting about a first axis;

a left handle having a first recess dimensioned to receive said left pliers;

a second pivot means for pivotally attaching said left handle to said right pliers, said right pliers and said left handle pivoting about a second axis perpendicular to said first axis;

a right handle having a second recess dimensioned to receive said right pliers;

a third pivot means for pivotally attaching said right handle to said left pliers, said left pliers and said right handle pivoting about a third axis perpendicular to said first axis and aligned with said second axis so that said left and said right pliers rotate together about said second and said third axes, respectively, from a fully extended position to a fully retracted position whereby said left pliers is received into said first recess of said left handle and said right pliers is received into said second recess of said right handle;

said left and said right pliers openable and closable by separating and bringing together said left and said right handles, said left and right pliers cooperating to hold said object over a range of positions between said fully extended position and near said fully retracted position; and latching means for holding said left handle and said right handle together when said left and said right pliers are in said retracted position in said left and right handles, respectively, said latching means unlocking when said left and said right pliers are rotated to the extended position.

2. The tool of claim 1 further comprising:

a first group of at least one instrument;

a fourth pivot means in said left handle for rotatably attaching said first group to said left handle;

said left handle further comprising a third recess dimensioned to receive said first group;

said at least one instrument of said first group rotatable from a fully extended position to a fully retracted position whereby said at least one instrument of said first group is received into said third recess of said left handle.

3. The tool of claim 2 further comprising:

a second group of at least one instrument;

a fifth pivot means in said right handle for rotatably attaching said second group to said right handle;

said right handle further comprising a fourth recess dimensioned to receive said second group;

said at least one member of said second group rotatable about said fifth axis from a fully extended position to a fully retracted position whereby said at least one member of said second group is received into said fourth recess of said right handle.

4. The tool of claim 2 wherein said first group includes a screw driver means for turning a phillips head screw and a flat head screw.

5. The tool of claim 4 wherein said screw driver means comprises:

an elongated member having a first end and a second end, said first end rotatably attached to said fourth pivot means, and said second end having a generally rectangular cross-section, said cross-section reduced in size toward said second end to form a taper so that said second end fits a slot of a flat head screw and any two opposing slots of a phillips head screw.

6. The tool of claim 2 wherein said first group includes a wrench means, said wrench means comprising an elongated piece of metal having a first end and a second end, said first end rotatably attached to said fourth pivot means, and said second end comprising at least one wrench-shaped cut.

7. The tool of claim 2 wherein said instruments of said first group and said instruments of said second group include a knife, a serrated blade, a saw blade, a metal file, a wrench, and a screwdriver.

8. The tool of claim 2 wherein said instruments and said left and right pliers are color-coded.

9. The tool of claim 1 wherein said left handle and said right handle are made of a moldable, glass reinforced material.

10. A tool comprising:

a handle having a recess;

a pliers;

a means for rotatably attaching said pliers to said handle so that said pliers rotates into and out of said recess from a retracted to an extended position, said pliers operable when rotated to a position intermediate between said retracted and said extended positions, said pliers operable with one hand;

a screwdriver;

a means for rotatably attaching said screwdriver to said handle so that said screwdriver may be rotated without rotating said pliers, said screwdriver dimensioned to fit a slot of a flat head screw and any two opposing slots of a phillips head screw;

a wrench;

a means for rotatably attaching said wrench so that said wrench may be rotated without rotating said pliers;

a knife blade;

a metal file;

a serrated blade; and a saw blade.

11. A tool comprising:

a left handle having a first recess;

a right handle opposing said left handle, said right handle having a second recess;

a plurality of instruments divided into a first group and a second group, said first group positioned in said first recess, said second group positioned in said second recess;

means for rotatably attaching said first group to said left handle and said second group to said right handle so that each instrument of said first group may be rotated out of said first recess and each instrument of said second group may be rotated out of said second recess of said second recess;

a latch for securing said left handle to said right handle;

a first cooperative instrument of said first group;

a second cooperative instrument of said second group, said first cooperative instrument and said second cooperative instrument connected together so that as said first cooperative instrument is rotated from said first recess said second cooperative instrument is rotated from said second recess, said latch attached to said first cooperative instrument, said first and said second cooperative instruments cooperating together for performing a function.

12. The tool of claim 11 wherein said instruments are color-coded.

13. The tool of claim 11 wherein said first and said second handles are made of a moldable, glass reinforced material.

* * * * *